US010006211B2

(12) United States Patent
Stover et al.

(10) Patent No.: US 10,006,211 B2
(45) **Date of Patent: *Jun. 26, 2018**

(54) FLOORING SYSTEM HAVING ASSEMBLY CLIP AND RELATED METHOD

(71) Applicants: Evan J. Stover, Tyrone, PA (US); Lee R. Stover, Tyrone, PA (US)

(72) Inventors: Evan J. Stover, Tyrone, PA (US); Lee R. Stover, Tyrone, PA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/237,843

(22) Filed: Aug. 16, 2016

(65) Prior Publication Data

US 2016/0356048 A1 Dec. 8, 2016

Related U.S. Application Data

(63) Continuation of application No. 14/691,012, filed on Apr. 20, 2015, now Pat. No. 9,441,379.

(60) Provisional application No. 62/042,466, filed on Aug. 27, 2014.

(51) Int. Cl.
*E04F 15/02* (2006.01)
*E04F 15/04* (2006.01)

(52) U.S. Cl.
CPC .. *E04F 15/02044* (2013.01); *E04F 15/02016* (2013.01); *E04F 15/02022* (2013.01); *E04F 15/04* (2013.01); *E04F 2015/0205* (2013.01); *E04F 2015/02116* (2013.01); *E04F 2201/0146* (2013.01); *E04F 2201/0511* (2013.01); *E04F 2201/0517* (2013.01)

(58) Field of Classification Search
CPC ..... E04F 15/02005; E04F 15/02011; E04F 15/02016; E04F 15/02022; E04F 2015/0205; E04F 2015/02066; E04F 2015/02105
See application file for complete search history.

(56) References Cited

U.S. PATENT DOCUMENTS 1,407,679 A 2/1922 Ruthrauff
3,045,294 A 7/1962 Livezey, Jr.
(Continued)

FOREIGN PATENT DOCUMENTS

EP 1 513 993 B1 2/2009

OTHER PUBLICATIONS

A guide to the installation of Junckers 20.5mm, 22mm and 14mm clip system floors; Junckers Limited; www.junckers.com; May 2000 (6 pages)s.

*Primary Examiner* — Elizabeth A Quast
(74) *Attorney, Agent, or Firm* — Barclay Damon, LLP

(57) ABSTRACT

A flooring system includes a plurality of individual flooring pieces, such as floor panels, each having a wear surface, an opposing mounting surface and a retention groove disposed within the mounting surface. A floor panel connector used to interconnect at least two of the floor panels has a base, at least one mast extending from an upper surface of the base and a pair of flexible arms. Each flexible arm extends transversely from opposing sides of the at least one mast and has an extending end. Contacting portions extending from a lower surface of the base are configured to engage the support surface and create a spacing between each flexible arm and the support surface to permit each flexible arm to elastically deflect toward the support surface when pressure is exerted on a floor panel. This deflection enables the extending end of each flexible arm to engage the retention groove of a corresponding floor panel.

20 Claims, 3 Drawing Sheets

(56) References Cited

U.S. PATENT DOCUMENTS 3,463,304 A 8/1969 Braeuninger et al.
3,577,594 A 5/1971 Omholt
3,619,963 A 11/1971 Omholt
3,731,445 A 5/1973 Hoffmann et al.
3,759,007 A 9/1973 Thiele
4,169,685 A 10/1979 Toshio
4,299,070 A 11/1981 Oltmanns et al.
4,599,841 A 7/1986 Haid ..... E04F 15/02005 52/396.04
4,703,597 A 11/1987 Eggemar
4,819,932 A 4/1989 Trotter, Jr.
4,905,442 A 3/1990 Daniels
5,148,850 A 9/1992 Urbanick
5,179,812 A 1/1993 Hill
5,216,861 A 6/1993 Meyerson
5,295,341 A 3/1994 Kajiwara
5,394,567 A 3/1995 Nystrom
5,706,621 A 1/1998 Pervan
6,023,907 A 2/2000 Pervan
6,134,854 A 10/2000 Stanchfield
6,363,577 B1 4/2002 Chen et al.
6,449,918 B1 9/2002 Nelson ..... E04F 15/04 52/570
6,460,306 B1 10/2002 Nelson
6,516,579 B1 2/2003 Pervan
6,536,178 B1 3/2003 Pälsson et al.
6,550,206 B2 4/2003 Lee
6,591,568 B1 7/2003 Pälsson et al.
6,694,691 B2 2/2004 Ku
6,763,643 B1 7/2004 M.ang.rtensson ..... F04F 15/02 52/403.1
6,769,217 B2 8/2004 Nelson
6,857,242 B2 2/2005 He
6,966,161 B2 11/2005 Palsson ..... B44C 3/123 404/41
7,171,790 B2 2/2007 Mei
7,243,470 B2 7/2007 Chae
7,386,963 B2 6/2008 Pervan ..... E04F 15/02 52/578
7,654,054 B2 2/2010 Moriau et al.
7,654,055 B2 2/2010 Ricker
7,805,903 B2 10/2010 Liu ..... E04F 15/04 52/489.1
8,006,458 B1 8/2011 Olofason ..... E04F 15/02 52/489.1
8,037,656 B2 10/2011 Liu et al.
8,266,863 B2 9/2012 Knauseder
8,276,343 B2 10/2012 Yang
8,429,870 B2 4/2013 Chen et al.
8,763,340 B2 7/2014 Pervan ..... E04F 15/02038 52/582.2
8,806,828 B2 8/2014 Suthar
9,003,736 B2 4/2015 Schoneveld ..... E04F 15/02005 52/468
2004/0244325 A1 12/2004 Nelson ..... E04F 15/04 52/582.1
2007/0240376 A1 10/2007 Engstrom
2012/0260602 A1 10/2012 Baker et al.
2013/0042563 A1 2/2013 Pervan ..... E04F 15/02038 52/582.2
2014/0026513 A1 1/2014 Bishop ..... E04F 15/02016 52/589.1
2014/0057076 A1 2/2014 Della Pepa ..... B32B 3/02 428/138
2015/0040508 A1 2/2015 Zhang ..... E04F 15/02038 52/582.1
2015/0096256 A1 4/2015 Lam ..... E04F 15/02044 52/582.1
2015/0113903 A1 4/2015 McManus ..... E04F 15/02044 52/586.1

FLOORING SYSTEM HAVING ASSEMBLY CLIP AND RELATED METHOD

CROSS REFERENCE TO RELATED APPLICATIONS

This application is a continuation of co-pending U.S. application Ser. No. 14/691,012, filed Apr. 20, 2015, which claims priority from U.S. Provisional Application Ser. No. 62/042,466, filed Aug. 27, 2014, each of which is incorporated herein by reference in its entirety.

TECHNICAL FIELD

This application relates generally to the field of building construction, and more specifically to a flooring system that includes complementary fastening clips and a related construction method using same.

BACKGROUND

Wood floors are a durable and elegant flooring option for purposes of either constructing or remodeling an interior space. However, wood is not a simple material, at least for purposes of fabrication. That is, wood is both hydroscopic and anisotropic. As is generally known, the term "hydroscopic" means that wood will readily exchange water with its surroundings, in which any gain or loss of water can result in dimensional changes to the machined shape of a wooden object. In addition, these dimensional changes are also "anisotropic", meaning that the wooden object being fabricated does not change dimension with equal magnitude in every direction. Resulting unequal dimensional changes can lead to several problems or issues during the service life of wood floors. These issues can include crowning or cupping of individual flooring pieces, gapping between adjacent flooring pieces, and localized or widespread heaving of the floor, among others.

Many of the current floor installation assembly methods employed by those in the industry mitigate the above-noted dimensional issues by mechanically restraining the connected sections of wood with fasteners and adhesives, bonding each section to a structural substrate. These assembly systems are sufficient as long as the dimensional variation in the material does not create forces that exceed either the elastic limit of the flooring material or the forces created by the fasteners and adhesives bonding the flooring material to the structural substrate.

So-called "floating floors" are an ideal way to compensate for dimensional changes in a flooring material, since the floor is not directly fastened (and therefore constrained) to a structural substrate. Instead, the floor is joined to the remaining flooring components making up the floating floor. This latter technique allows the floor to change dimension as a single composite sheet, preventing noticeable gapping between adjacent flooring pieces. Providing for lateral movement also prevents failure of the flooring material that can result from confining dimensional changes. The joining of the various flooring components is primarily achieved by forming or milling small interlocking tongue and groove sections into the flooring planks. While this technique has been made possible with engineered laminate and composite wood floors, success has not been achieved with solid wood due to directional weaknesses in the material.

There are known static connector systems that can be used with more dimensionally stable materials, such as so-called "compact laminate." These latter systems rely on relatively precise matching between grooves and/or protrusions on each wood panel with corresponding protrusions and/or grooves on the static connector, thereby creating a mechanical interference or press fit. Connectors of this type have not found widespread application in wood product flooring assembly systems. The dimensional variation(s) experienced by wood products following installation changes the shape of all machined services. Therefore, as the flooring components are caused to shrink or swell, creating forces that the connector would need to overcome, the shape and size of grooves and protrusions on the wood product flooring components needed to interface with the static connector will also change accordingly. The change could reduce or otherwise compromise effectiveness of the mechanical interference or press fit that is required to hold the various flooring components together.

BRIEF DESCRIPTION

According to a first aspect, there is provided a flooring system comprising a plurality of flooring pieces configured to be disposed onto a support surface, each flooring piece having a wear surface, an opposing mounting surface and a mounting groove disposed within the mounting surface; and a plurality of connectors, each connector being configured for securing a pair of individual flooring pieces together on the support surface. Each connector comprises a base, at least one center mast vertically extending from the base for retaining a first flooring piece and aligning a second flooring piece therewith, and a pair of flexible arms. Each flexible arm extends transversely from opposing sides of the at least one center mast and has a inwardly curved engagement end wherein the base comprises contacting portions extending from a lower surface of the base that are configured to engage the support surface. The contacting portions are sized to create a spacing between each flexible arm and the support surface, thereby permitting each flexible arm to elastically deflect toward the support surface when pressure is exerted on a flooring piece and thereby enable the inwardly curved engagement end of each flexible arm to engage the mounting groove of the flooring pieces.

According to another aspect, there is provided a connector for enabling attachment of a pair of floor panels relative to a support surface. Each floor panel includes a wear surface and an opposing mounting surface having an angled retention or clamping groove, the connector comprising at least one center mast extending from a base configured for retaining a first floor panel prior to attachment of a second floor panel; and a pair of flexible arms extending transversely from opposing sides of the at least one center mast. Each of the flexible arms includes a curved extending end that is configured for engaging the retention groove of a floor panel, wherein the base comprises contacting portions that extend from a lower surface of the base and are configured to contact the support surface and define a spacing between the flexible arms and the support surface to enable either of the flexible arms to elastically deflect toward the support surface to permit the engagement end to mate with the angled retention groove.

According to yet another aspect, there is provided a method for forming a subfloor onto a support surface, the method comprising:

securing a first flooring piece to a connector by engaging a cantilevered end of a first flexible arm of the connector to a retaining groove formed in a mounting surface of the first flooring piece, the connector including a base placed in contact with the support surface;

retaining an edge of the first flooring piece relative to a post member of the connector;

aligning an edge of a second flooring piece to a post member of the connector; and applying pressure to the second flooring piece toward the support surface in which a second flexible arm of the connector is caused to elastically deflect and enable an inwardly curved end of the second flexible arm to engage a retaining or clamping groove formed in the mounting surface of the second flooring piece, thereby securing the first and second flooring pieces together.

As such, a flooring system is provided in which flooring components are joined to each other over the top of, but otherwise unattached to, an underlying subfloor by the use of a plurality of the herein described connectors that eliminate the need for adhesives or fasteners extending through the various flooring components and into a structural substrate. In one version, the connectors comprise clip members that include sections having a continuous profile including a supporting base, a beaded alignment mast extending transversely from the center of the supporting base and two hooked or suitably shaped clamping arms extending outwardly from opposing sides of the mast along the base. The beaded alignment mast is configured to index into an alignment groove provided on an edge of one of the flooring pieces, while the hooked clamping arms are configured to engage a clamping or retention groove formed on the bottom of each of the interconnected flooring pieces. With this described system, flooring pieces may be secured to one another simply by pressing the flooring pieces into place on the floor panel connectors.

Advantageously, the herein described system enables dimensional changes to the floating floor to be distributed, minimizing the effects of stress.

Another advantage is that the herein described fastening clip is durable and relatively inexpensive to manufacture.

Yet another advantage realized is the ability to incorporate flooring components made from different materials (i.e., solid hardwood and marble) into a single continuous floor despite these components having widely different physical and mechanical properties.

Still another advantage is that the herein described flooring system does not require special equipment typically used in hardwood flooring installation, such as flooring nail guns and flooring jacks.

Yet another advantage provided is that flooring installation using the herein described system and method may be done without advanced training or need of specialized tradesman.

Still another advantage is a better yield being realized from the flooring material in that material is not lost, for example, to the molding of a tongue on one edge of each flooring panel, as in presently known installation systems.

Another advantage is that a floor installed in accordance with the herein described system and method will not require sanding or other finishing steps after installation because the connector used retains each flooring piece (panel) in the same plane supported above the subfloor (support) surface and/or underlayment.

Furthermore, wooden flooring components may be completely finished on all surfaces at the manufacturer's facility because sanding and finishing is not required after installation.

The herein described system provides additional advantages in that individual flooring pieces can be removed and replaced with minimal disturbance to the remainder of the floor in the event a flooring piece is damaged. Moreover, entire floors can be easily removed and replaced or otherwise reconfigured using the herein described system. For example, the flooring panels can be removed and refinished elsewhere, then returned for easy reassembly. Having the ability to conduct refinishing remotely avoids the associated dust, noise and finishing chemicals that are associated with refinishing known nailed or glued hardwood floors.

These and other features and advantages will be readily apparent from the following Detailed Description, which should be read in conjunction with the accompanying drawings.

DETAILED DESCRIPTION

The following relates to exemplary embodiments of a sub-flooring system (also herein referred to as a "floating floor"), including an floor panel connector (also synonymously referred to throughout as an "assembly clip", or "assembly connector") that is configured to secure together a pair of floor components (i.e., floor panels) onto a supporting surface or substrate. It will be readily apparent that other variations and modifications can be contemplated by a person of sufficient skill that further embodies the inventive ambits which are described herein. Throughout the course of discussion, a number of descriptive terms are used in order to provide a suitable frame of reference with regard to the accompanying drawings. These terms, which may include "outer", "inner", "internal", "external", "above", "below", "top", "beneath", and the like are not intended to otherwise limit the effective scope of this application, including the appended claims, unless so specifically indicated.

In addition, it should be noted that the accompanying drawings are not drawn to scale and therefore the reader should not overly rely upon same for scaling purposes.

For purposes of the description that follows, the terms "a", "the" though referring specifically to single items are to be interpreted to mean "at least one". Therefore, in referring for example to a center mast, a description made herein is "a center mast" or "the center mast" may infer "at least one" center mast.

The terms "including", "include", "comprises", "comprising" and the like are intended to be open-ended terms that are minimally inclusive of the terms or elements associated with these terms.

The terms "flooring components", "flooring pieces" and "flooring panels" are used synonymously throughout this discussion and relate to sections of the floor that are assembled together using connectors, as described herein.

The terms "floor panel connectors" and "connectors" refer to those portions of the herein described flooring system and method that are used to interconnect individual flooring components.

Figure 1:
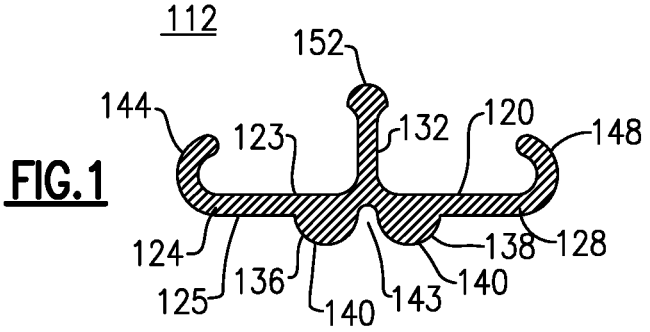
FIG. 1 is a side elevational view, taken in section, of an exemplary embodiment of a floor panel connector for use in a floating floor system.
Figure 2:
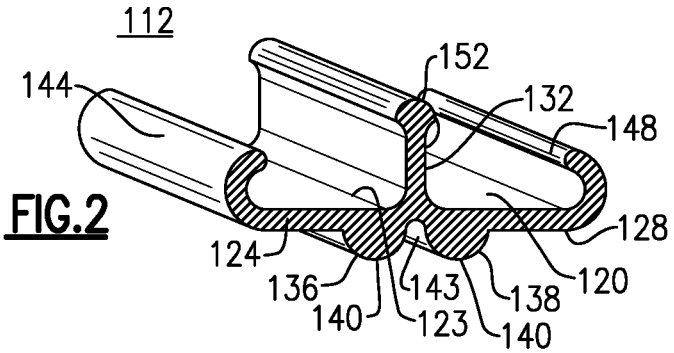
FIG. 2 is a perspective view, partially in section, of the floor panel connector of FIG. 1.
Figure 5:
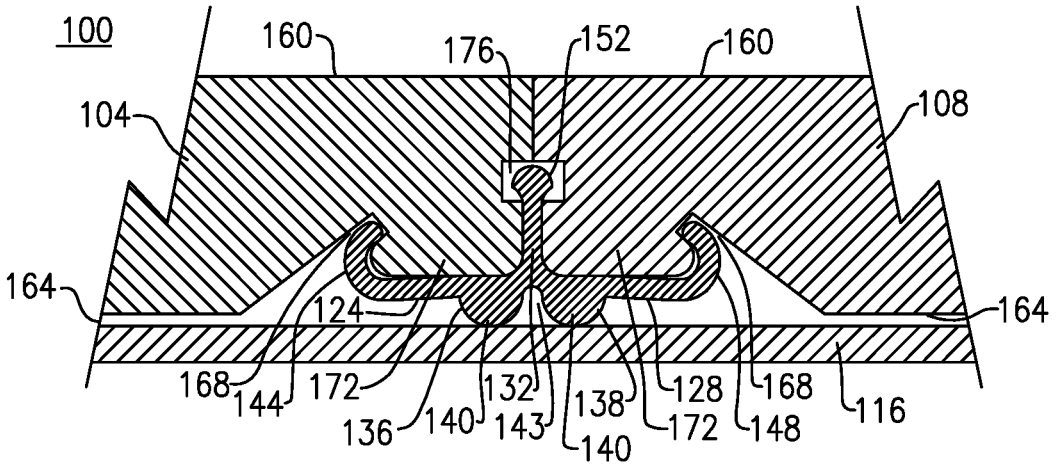
FIG. 5 depicts a sectioned elevational view of the floor panels of FIGS. 3 and 4 by the floor panel connector of FIGS. 1-4.
Figure 3:
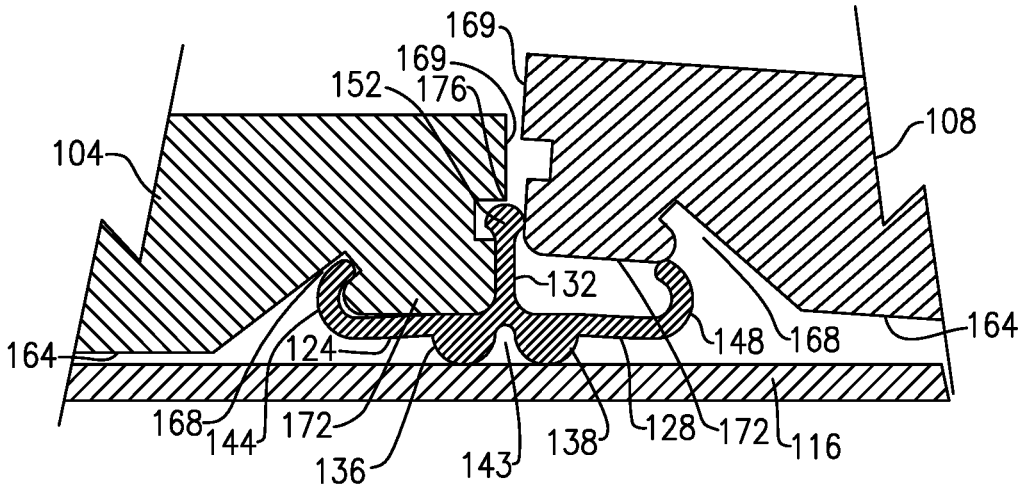
FIGS. 3 and 4 are partial assembly views, shown in section, of the floor panel connector of FIGS. 1 and 2, sequentially depicting the interconnection of adjacent floor panels to the floor panel connector.
Figure 4:
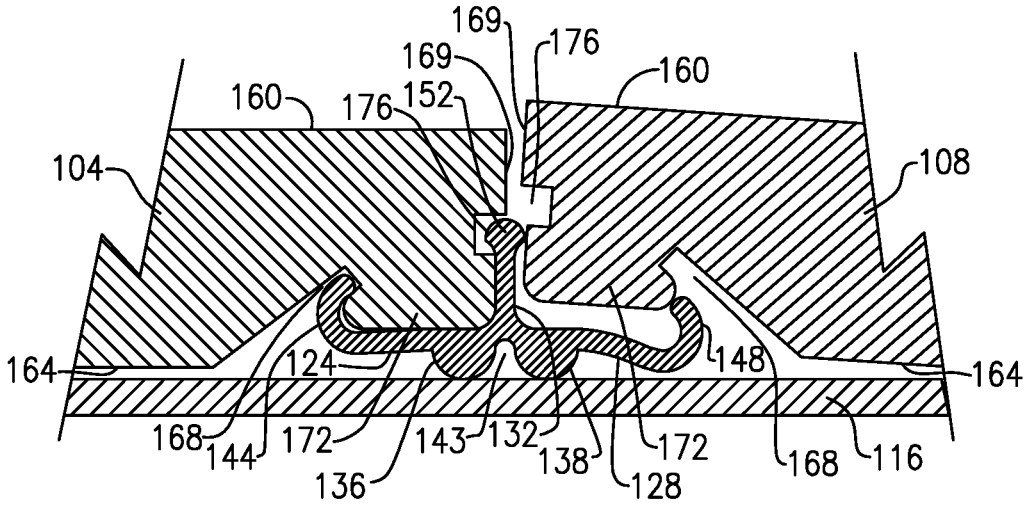

Referring to FIGS. 1 and 2, there is shown a floor panel connector 112 that is made in accordance with an exemplary embodiment and for use as part of a floating flooring system 100, which is partially shown in FIGS. 3-5. As discussed herein, the floating flooring system 100 comprises a plurality of flooring pieces (i.e., floor panels) in which specific engagement or interconnection is achieved between a pair of individual flooring pieces 104, 108 using the floor panel connector 112, and in which the floating flooring system 100 is entirely disposed above or onto a planar support surface or substrate 116.

The floor panel connector 112 according to a first exemplary embodiment is defined by a unitary member which is fabricated from a durable flexible material, such as, for example, a molded or extruded plastic. The floor panel connector 112 includes a base 120 having an upper surface 123 and an opposing lower surface 125. The base 120 of the floor panel connector 112 is further defined by a pair of flexible arms 124, 128, each flexible arm 124, 128 being disposed transversely from opposing sides of a center alignment mast 132. The base 120 further includes a pair of contacting portions 136, 138, each projecting from the lower surface 125 of the base 120 and spaced from one another on adjacent sides of the center alignment mast 132 and configured to directly engage the support surface 116. Each contacting portion 136, 138 is commonly defined by a substantially hemispherical surface 140 in which a slot or recess 144 is provided between the contacting portions 136, 138 at substantially the center of the connector 100. Respective ends 144, 148 of the flexible arms 124, 128 are each curved inwardly in a direction extending toward the center mast 132. The center alignment mast 132 extends from the upper surface 123 of the base 120 and includes a bulbous upper end 152 having a widened thickness, as compared to the thickness of the remainder of the center alignment mast 132.

Referring to FIGS. 3-5, each of the flooring pieces 104, 108 used in combination with the floor panel connector 112 are defined by a wear or upper surface 160, as well as an opposing mounting or lower surface 164. An angled clamping or retention groove 168 is formed within the mounting surface 164 of each flooring piece 104, 108 that is spaced a predetermined distance from an inner edge 169 of each flooring piece 104, 108. More specifically and according to this embodiment, the mounting surface 164 includes a recessed portion 172 adjacent the inner edge 169 of each of the flooring pieces 104, 108 and extending to the angled retention groove 168, the latter being defined between the recessed portion 172 and the remainder of the mounting surface 164. As discussed herein, the recessed portion 172 is defined by a width dimension that is slightly smaller than a corresponding dimension between the base 120 and the flexible arm 124 in order to provide a snap-fit accommodation for the floor panel connector 112. The lower corners of the recessed portion 172 are preferably rounded and wherein the retention groove 168 is defined by an acute angle of approximately 38 degrees, though this parameter can be suitably varied to cover other suitable angles that enable retention of a complementary flooring piece. The flooring pieces 104, 108 can be manufactured from solid wood in accordance with this specific embodiment, although other suitable structural materials such as laminate, metal and the like can also be utilized.

Referring to FIGS. 3-5, the formation of a floating floor in accordance with this exemplary embodiment is herein described, which includes the interconnection of the flooring pieces 104, 108 being shown in sequence. First, one of the flooring pieces 104 is initially attached to the floor panel connector 112 by hand. To effect this attachment, the floor panel connector 112 aligned with the first flooring piece 104. More specifically, the inner edge 169 of the first flooring piece 104 is aligned with and engaged with the center alignment mast 132 and the recessed portion 172 is pressed into engagement with the upper surface 123 of the base 120 of the connector 112. The flooring piece 104 or the floor panel connector 112 is initially tilted to create this engagement and in which the flexible arm 124 is caused to deflect downwardly and outwardly (relative to the center mast 132) in order to accommodate the recessed portion 172, which has a slightly wider dimension than the initial spacing between the flexible arm 124 and the mast 132. When secured as shown in FIG. 3, the inwardly extending end 144 of the flexible arm 124 is caused to engage the angled retention groove 168, thereby releasably securing the first flooring piece 104 in place. In this position, the lower portion of the inner edge 169 is engaged with the center mast 132 and the bottom surface of the recessed portion 172 is engaged with the upper surface 123 of the base 120 of the connector 112. When assembled, the bulbous upper end 152 of the center alignment mast 132 is engaged with a corresponding groove 176 that is formed in the inner edge 169 of the first flooring piece 104, which further aligns and effectively retains the assembly to permit the attachment of the second flooring piece 108, as herein discussed onto the support surface 116.

Referring to FIGS. 3 and 4, the second flooring piece 108 is then initially tilted with the mounting surface 164 being placed in contact with the support surface 116. As the second flooring piece 108 is pressed downwardly toward the support surface 116, the flexible arm 148 of the floor panel connector 112 is caused to deflect, as shown in FIG. 4, due to the spacing provided by the contacting portions 136, 138 and with the curved end 148 of the flexible arm 128 being moved into engagement with the angled retention groove 168 of the second flooring piece 108. The first flooring piece 104 is retained by the connector 112 during this part of the assembly process. In this assembled position and with reference to FIG. 5, the recessed portion 172 of the second flooring piece 108 is retained tightly within the space provided between the center alignment mast 132 and the curved end 148 of the flexible arm 128 of the floor panel connector 112. As noted, the flexible nature of the arm 128 and the spacing created by the lower contacting portions 136, 138 enable sufficient elastic deformation to enable a snap fit of the curved engagement end 148 with the angled retention groove 168 of the second flooring piece 108 and due to the recessed portion 172 having a slightly larger width dimension than that between the center mast 132 and the flexible arm 128 to achieve the snap fit.

The completed assembly 100 is depicted in FIG. 5 between the two adjacent flooring pieces 104, 108 in which the contacting portions 136, 138 engage the support surface 116 and the mounting surface 164 is in close, but spaced proximity with the support surface 116. The bulbous upper end 152 of the center alignment mast 132 is retained within the space formed by the aligned grooves 176. Other individual flooring pieces (not shown) can be interconnected similarly at the edges thereof to create an overall floating floor structure onto the support surface 116 without the use of adhesives, nails or similar types of fasteners and wherein applied loads to the wear surface 160 of the assembled flooring pieces are adequately distributed to the defined structure.

Figure 6:
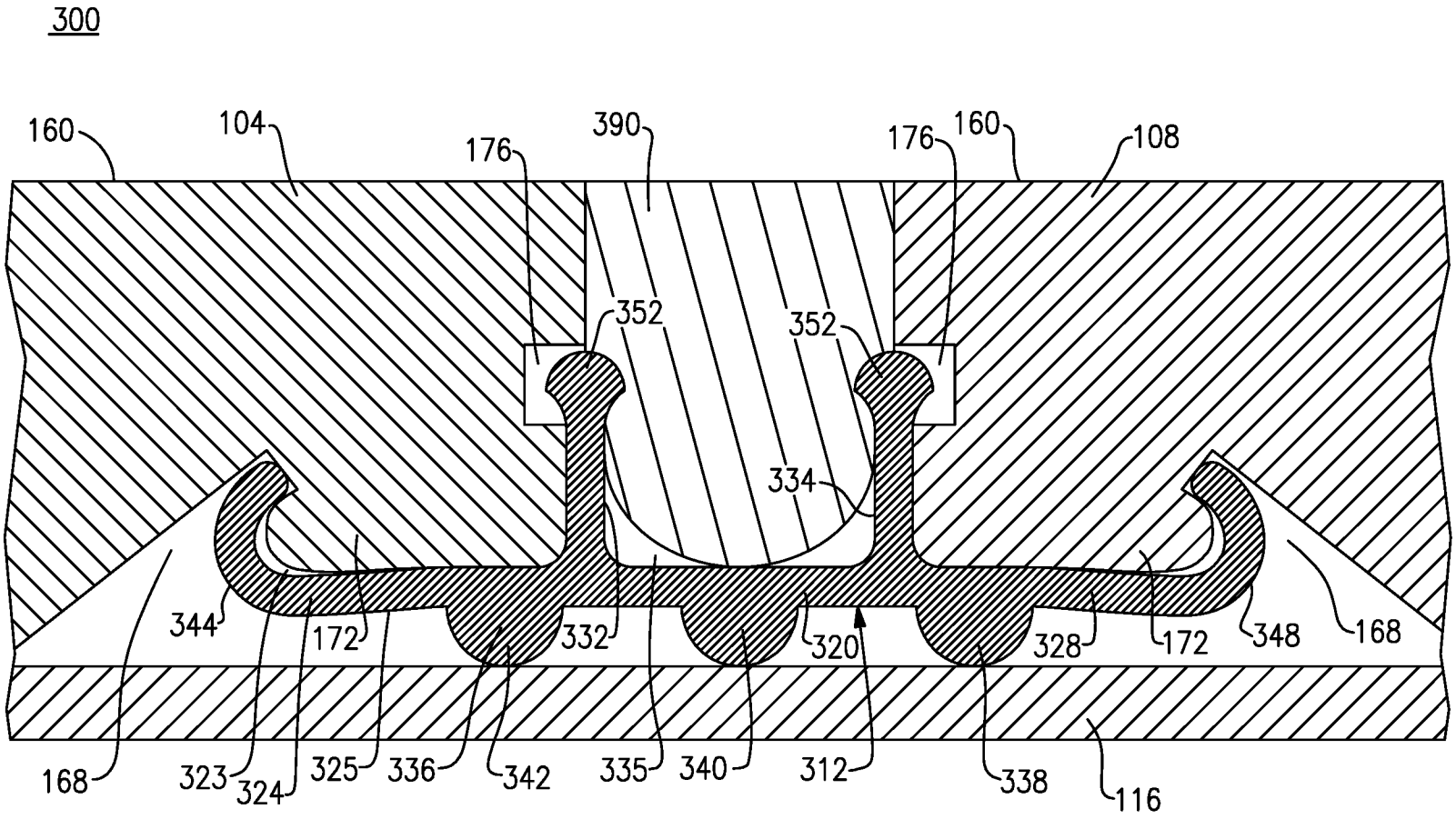
FIG. 6 is a sectioned elevational view of a portion of a flooring system, including a floor panel connector which is made in accordance with another exemplary embodiment.

Referring to FIG. 6, there is shown another exemplary embodiment of a floating floor assembly or system 300. Similar parts are herein labeled with the same reference numerals for the sake of clarity. As in the preceding version, a pair of flooring pieces 104, 108 (i.e., floor panels, partially shown) can be disposed onto a planar support surface 116 in which each of the panels are defined by corresponding upper (wear) and lower (mounting) surfaces 160, 164, respectively. As in the preceding, the mounting surface 168 is further defined by an angled retention or clamping groove 168 as well as a rounded recessed portion 172 adjacent an inner edge 169 of the flooring pieces 104, 108.

A floor panel connector 312 used to interconnect the flooring pieces 104, 108, is made from a suitable material, preferably a molded or extruded plastic although other suitable structural materials can also be substituted. According to this specific embodiment, the floor panel connector 312 is defined by a base 320 having an upper surface 323 and a lower surface 325, the floor panel connector 312 further including a pair of post or mast members 332, 334 that extend upwardly from the upper surface 323 of the base 320 with a defined spacing 335 therebetween. The post members 332, 334 commonly include a bulbous upper end 352, the latter having a thickness which is larger than the remainder of each post member 332, 334.

The base 320 further includes a pair of flexible arms 324, 328 that each extend transversely from the post members 332, 334 and include respective inwardly curved ends 344, 348 that are curved inwardly (i.e., toward the post members 332, 334). The base 320 further includes a plurality of contacting portions configured to engage the support surface 116. According to this specific embodiment, three (3) contacting portions 336, 338, 340 are provided in spaced relation extending from the lower surface 325 in which one of the support portions 340 is disposed at substantially the center of the span of the base 320, with each of the remaining contacting portions 336, 338 being disposed adjacent each of the post members 332, 334 and outboard in relation thereto. Each of the contacting portions 336, 338, 340 are further defined by a substantially hemispherical surface 342.

In terms of assembly and still referring to FIG. 6, the first flooring piece 104 is attached to the floor panel connector 312 in a manner similar to that of the prior embodiment. More specifically and according to this embodiment, the recessed portion 172 of the first flooring piece 104 is engaged with upper surface 323 of the base 320 of the panel connector 312 with the inner edge 169 of the first flooring piece 104 being engaged against the first mast member 332. Due to the larger size (width) of the recessed portion 172 relative to the spacing initially provided between the first post member 332 and the flexible arm 324, the flexible arm 324 is caused to deflect elastically to accommodate the recessed portion 172 with the curved end 344 of the flexible arm 324 being sized and configured to engage the angled retention groove 168 of the first flooring piece 104. In this position, the rounded recessed portion 172 of the first flooring piece 104 is tightly and snap fittingly engaged between the angled retention groove 168 and the first post member 332 with the bulbous upper end 352 of the first post member 332 being engaged with a groove 176 intermediately formed along the upper edge 169.

The second flooring piece 108 is then attached to this assembly initially tilting the second flooring piece 108 toward the support surface 116 and providing downward force against the flexible arm 328, causing the arm 328 to deflect due to the spacing provided by the contacting portions 338, 340 and the curved end 348 to be engaged with the angled groove 168 with the recessed portion 172 of the second flooring piece 108 being tightly retained between the second post member 334 and the retention groove 168 in a snap fitting arrangement. An inlay or insert 390 made from marble or other material can be introduced to this assembly within the spacing 335 that is defined by the post members 332, 334, which is sized to retain same. The inlay 390 can be provided either at the end of the assembly process or prior to attachment of either the first and/or second flooring pieces 104, 108, depending on the rigidity of the inlay and to insure the connector 320 can maintain a level of flexibility to permit attachment of the flooring pieces 104, 108. As such and according to this embodiment, the insert 390 would be removable and permit replacement thereof, but without having to replace or remove the remainder of the flooring assembly 300. In one version, the inlay 390 can at least partially comprise a material that includes a flexible undersurface that facilitates attachment and removal of same. In this manner, various styles of inserts 390 could be interchangeably utilized.

The exemplary embodiments disclosed herein are not intended as a restriction or limitation on the application, composition, structure and manufacturing method of the invention. It will be readily apparent that other variations and modifications are possible within the inventive ambits that are described herein.

The present inventive system and method is directed to the application of floor assembly systems including flooring panels, squares, rectangles and other varied shapes of either solid wood, laminate or composite wood products. However, the application of the presently described system and method to other alternative materials such as bamboo, filled and unfilled polymeric materials (naturally occurring or man-made), ceramics, stone, and metals is also contemplated. In addition, this application is further suitable for any rigid backed panel assembly having a non-rigid wear surface (e.g., carpet, rubber, athletic padding, or artificial turf) as well as combinations of any of the above.

The above-described flooring panels are manufactured utilizing techniques known in the art. During or after manufacturing, panels may be machined or otherwise modified or formed by any technique known in the art to create the appropriate recesses in the bottoms and edges thereof that cooperate with the herein described fastening clips.

These appropriate recesses shall be defined as any structural feature or group of features that promotes the interface with and function of any rendition or manner of the floor panel connector described herein.

Moreover, the connector(s) described may be manufactured from materials selected from the group that includes filled and unfilled polymeric materials (naturally occurring or man-made), ceramics, metals, and combinations thereof. Preferably, in use with the above-described flooring panels, the floor panel connector of the claimed system is manufactured from polymeric materials or metal. Depending on the material and size, the connector may also be manufactured from techniques known in the art, e.g., the connector is preferably fabricated from extruded, filled or unfilled polymeric materials.

PARTS LIST FOR FIGS. 1-6

100 floating flooring system
104 flooring piece

108 flooring piece
112 floor panel connector (assembly clip)
116 support surface
120 base
123 upper surface, base
124 flexible arm
125 lower surface, base
128 flexible arm
132 center alignment mast
136 contacting portion
138 contacting portion
140 substantially hemispherical surface
143 slot or recess
144 end, inwardly curved
148 end, inwardly curved
152 bulbous upper end, center alignment mast
160 upper (wear) surface
164 lower (mounting) surface
168 retention groove
169 inner edge
172 recessed portion, mounting surface
176 groove, inner edge
300 flooring assembly or system
312 floor panel connector
320 base
323 upper surface
324 flexible arm
325 lower surface
328 flexible arm
332 post or mast member, first
334 post or mast member, second
335 spacing
336 contacting portion
338 contacting portion
340 contacting portion
342 substantially hemispherically shaped surface
344 end, flexible arm
348 end, flexible arm
352 bulbous upper end, post members
390 inlay or insert These and other modifications and variations of the system, connector and methods of using and fabricating same will be readily apparent to one of sufficient skill from the following claims:

We claim:

1. A flooring system comprising:

a pair of flooring pieces disposed above a support surface, each of the flooring pieces comprising:

an upper wear surface;

an opposing lower mounting surface;

an inner edge; and an outer edge, in which at least one of the flooring pieces further includes a retention groove disposed within the lower mounting surface, the retention groove formed at an intermediate part of the lower mounting surface between the inner and outer edges and defined by an acute angle extending upwardly toward the upper wear surface and inwardly toward the inner edge; and a floor panel connector that secures the pair of flooring pieces to one another, the floor panel connector comprising:

a base having a lower surface and at least one contacting portion projecting from the lower surface, said at least one contacting portion configured for engaging the support surface; and at least one flexible cantilevered arm having an inwardly curved engagement end wherein the at least one contacting portion creates a spacing between the at least one flexible cantilevered arm and the support surface to enable the arm to be elastically deflected toward the support surface when pressure is exerted on a flooring piece and cause the inwardly curved engagement end of the at least one flexible cantilevered arm to engage and be retained within the retention groove of the flooring piece.

2. The flooring system according to claim 1, wherein the floor panel connector includes at least one mast extending upwardly from the base.

3. The flooring system according to claim 2, wherein the at least one mast includes an alignment feature for engaging the inner edge of a connected flooring piece.

4. The flooring system according to claim 3, wherein at least one of the pair of flooring pieces and the mast includes an alignment feature.

5. The flooring system according to claim 2, wherein the floor panel connector includes at least two contacting portions for engaging the support surface.

6. The flooring system according to claim 5, including at least one contacting portion projecting downwardly from the lower surface of the base on each opposing side of the at least one mast.

7. The flooring system according to claim 6, wherein the at least one contacting portion is defined by a hemispherical surface.

8. The flooring system according to claim 1, wherein the floor panel connector is made from plastic.

9. A flooring piece for use in a subfloor system, the flooring piece comprising:

an upper wear surface;

a lower mounting surface;

an inner edge;

an outer edge; and a retention groove disposed within the lower mounting surface between the inner edge and outer edge, said retention groove defined by an acute angle in which the retention groove extends inwardly from an intermediate portion of the lower mounting surface toward the inner edge and upwardly toward the upper wear surface of the flooring piece at the acute angle.

10. The flooring piece according to claim 9, wherein the inner edge includes at least one alignment feature.

11. The flooring piece according to claim 9, wherein the retention groove is further defined by a recessed portion in an upper portion of the groove.

12. The flooring piece according to claim 9, in which the acute angle is 38 degrees.

13. A method for manufacturing a flooring system, said method comprising:

forming a pair of flooring pieces, the forming step including the steps of forming an upper wear surface, a lower mounting surface, an inner edge and an outer edge for each flooring piece;

forming a retention groove in at least one of the flooring pieces, the retention groove being formed in the lower mounting surface between the inner edge and the outer edge and extending upwardly toward the upper wear surface from an intermediate portion of the lower mounting surface and extending inwardly toward the inner edge at an acute angle; and forming a floor panel connector having a base for engaging a support surface and at least one cantilevered arm configured for engaging the retention groove of the at least one flooring piece such that an inwardly curved end of the at least one cantilevered arm of the floor panel connector engages and is retained within the acutely angled retention groove.

14. The method according to claim 13, including the step of providing the floor panel connector with at least one contacting portion projecting downwardly from the base.

15. The method according to claim 14, including the step of forming the at least one contacting portion with a hemispherical surface.

16. The method according to claim 13, wherein the at least one contacting portion is configured for contacting a support surface and creating a spacing to permit the flexible cantilevered arm to deflect to permit engagement with the retention groove of a flooring piece.

17. The method according to claim 13, including the step of forming the floor panel connector with a pair of flexible cantilevered arms extending from opposite ends of the base.

18. The method according to claim 17, including the step of forming a pair of contacting portions on the base of the connector in relation to each of the pair of flexible cantilevered arms.

19. The method according to claim 13, including the step of providing the floor panel connector with at least one mast extending upwardly from the base.

20. The method according to claim 19, including the step of providing at least one alignment feature on the at least one mast.

* * * * *